US009593458B2

(12) United States Patent
Satlow

(10) Patent No.: US 9,593,458 B2
(45) Date of Patent: Mar. 14, 2017

(54) PILE COMPRISING A SUBSTANTIALLY CYLINDRICAL SHAFT

(71) Applicant: Tiroler Rohre GmbH, Hall in Tirol (AT)

(72) Inventor: Roland Satlow, Absam (AT)

(73) Assignee: TIROLER ROHRE GMBH, Hall in Tirol (AT)

( * ) Notice: Subject to any disclaimer, the term of this patent is extended or adjusted under 35 U.S.C. 154(b) by 0 days.

(21) Appl. No.: 14/925,169

(22) Filed: Oct. 28, 2015

(65) Prior Publication Data

US 2016/0160466 A1 Jun. 9, 2016

(30) Foreign Application Priority Data

Dec. 5, 2014 (AT) ..... A 879/2014

(51) Int. Cl.

| | |
|---|---|
| ***E02D 5/08*** | (2006.01) |
| ***E02D 5/52*** | (2006.01) |
| ***E02D 5/28*** | (2006.01) |
| ***E02D 5/48*** | (2006.01) |
| ***E02D 7/02*** | (2006.01) |
| ***E02D 5/24*** | (2006.01) |
| ***E02D 5/30*** | (2006.01) |

(52) U.S. Cl.

CPC ..... *E02D 5/526* (2013.01); *E02D 5/24* (2013.01); *E02D 5/28* (2013.01); *E02D 5/285* (2013.01); *E02D 5/30* (2013.01); *E02D 5/48* (2013.01); *E02D 5/52* (2013.01); *E02D 5/523* (2013.01); *E02D 7/02* (2013.01)

(58) Field of Classification Search

USPC ..... 405/231, 232, 251

See application file for complete search history.

(56) References Cited

U.S. PATENT DOCUMENTS

| | | | | |
|---|---|---|---|---|
| 1,507,138 A * | 9/1924 | Pierce | F16L 13/147 285/334.5 |
| 3,724,223 A * | 4/1973 | Pepe | E02D 5/523 138/89 |
| 4,569,617 A | 2/1986 | Schmidt et al. | |
| 7,722,093 B2 * | 5/2010 | Henke | F16L 13/148 285/13 |

FOREIGN PATENT DOCUMENTS

| | | |
|---|---|---|
| JP | 2007-120122 | 5/2007 |
| WO | 2013/026510 | 2/2013 |

OTHER PUBLICATIONS

European Search Report issued Dec. 22, 2015 in corresponding European Application No. 15 00 2971.

* cited by examiner

*Primary Examiner* — Sean Andrish

(74) *Attorney, Agent, or Firm* — Wenderoth, Lind & Ponack, L.L.P.

(57) ABSTRACT

A driven pile comprising a substantially cylindrical shaft, wherein the shaft provides a first pile end and a second pile end, wherein a socket is arranged on the driven pile in the region of the second pile end, wherein the socket or the driven pile has an abutment in the region of the second pile end so that a further driven pile can be inserted with a first pile end as far as a maximum insertion depth defined by the abutment, wherein the socket and/or the driven pile in the region of the second pile end provides or provide in the interior at least one undercut portion extending at least substantially to the abutment.

13 Claims, 3 Drawing Sheets

PILE COMPRISING A SUBSTANTIALLY CYLINDRICAL SHAFT

BACKGROUND OF THE INVENTION

1. Field of the Invention

The invention concerns a driven pile comprising a substantially cylindrical shaft, wherein the shaft provides a first pile end and a second pile end, wherein a socket is arranged on the driven pile in the region of the second pile end, wherein the socket or the driven pile has an abutment in the region of the second pile end so that a further driven pile can be inserted with a first pile end as far as a maximum insertion depth defined by the abutment.

2. Description of Related Art

Driven piles of the kind set forth in the opening part of this specification are already part of the state of the art and are shown, for example, in WO 2013026510 A1. Driven piles are driven into the bedrock by a driving apparatus. The term bedrock is used, for example, to denote the ground. When the first driven pile has been driven into the bedrock, a further driven pile can be inserted into the upper end of the driven pile which has already been driven in. The further driven pile is joined to the first driven pile by the action of force which is also implemented by the driving apparatus. In the state of the art, that joint is made by frictional engagement and force-locking engagement. The state of the art, however, does not always guarantee that the force for separating two or more driven piles is greater than the initial joining force which has been applied with the driving apparatus. In other words, the tensile force which the driven piles which are driven into each other can carry is too low for many areas of use. An increase in that tensile force above a value of the joining force applied for joining the piles is only possible with difficulty. Other systems operate, for example, with the incorporation of additional components like, for example, spreader elements to increase the tensile force between the individual piles by the tip of the driven piles being widened. In that case, however, cracks can occur, which in turn give rise to problems with regard to the tensile force and strength and stability of the connected driven piles and complicate the system.

SUMMARY OF THE INVENTION

The object of the invention is to avoid the above-described disadvantages and to provide a driven pile which is improved over the state of the art.

According to the invention, that object is attained by the characterizing portion described below.

The fact that the socket and/or the driven pile in the region of the second pile end in the interior provides or provide at least one undercut portion extending at least substantially as far as the abutment ensures that, after a further driven pile has been inserted and driven in, under the effect of a force, it is joined in positively locking relationship to the driven pile which has been previously driven into place, by virtue of the undercut configuration. By virtue of that joint, the arrangement comprising interconnected driven piles can withstand very high tensile forces in comparison with the state of the art. In addition, no further components like spreader elements are required.

Further advantageous embodiments are defined below.

BRIEF DESCRIPTION OF THE DRAWINGS

Further details and advantages of the present invention will be described more fully hereinafter by means of the specific description with reference to the embodiments by way of example illustrated in the drawings in which.

DETAILED DESCRIPTION OF THE INVENTION

Figure 1:
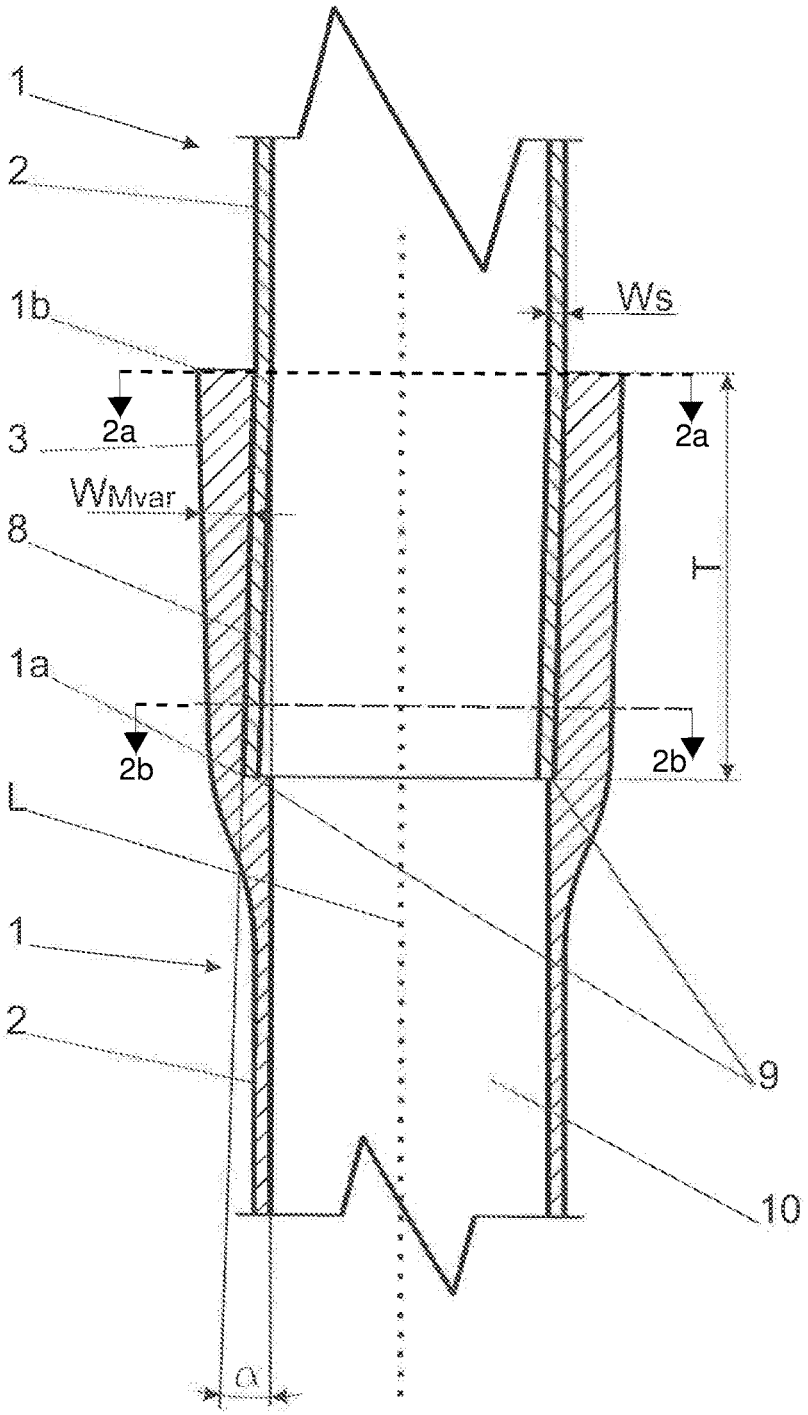
FIG. 1 shows a detail view of two joined driven piles.

FIG. 1 shows a sectional view of two driven piles 1 (not illustrated in their entirety). The driven piles 1 are formed from a substantially cylindrical shaft 2 providing a first pile end 1*a* and a second pile end 1*b*. As shown in FIG. 1, the first pile end 1*a* fits in the socket 3 of a further pile 1. In that case, the first pile end 1*a* is driven into the socket 3 as far as the abutment 9. At the second pile end 1*b*, the socket 3 has a substantially constant socket wall thickness WMcon. Starting from the first pile end 1*b* along the maximum insertion depth T, which is defined by the abutment 9, the socket wall thickness varies from the constant socket wall thickness WMcon to the variable socket wall thickness WMvar. That variation in the wall thickness affords an undercut portion 8 which extends at a maximum angle $\alpha$ in the interior of the socket 3 of between 1.5° and 3° measured relative to a longitudinal axis L. In other words, that undercut portion 8 is provided by the change in the cross section of the socket 3 from a substantially circular cross section Qk at the second pile end 1*b* to a cross section Qa which deviates from a circular cross section Qk and which is disposed at the inner abutment 9. FIG. 1 shows section 2*a*-2*a* and section 2*b*-2*b* which are described more fully in FIGS. 2*a* and 2*b* and show the change in cross section from the cross section Qk to Qa as plan views.

The driven pile 1, which is of a substantially tubular configuration, with a shaft 2, is of a substantially constant shaft wall thickness Ws at least along a maximum insertion depth T thereof, starting from the first pile end 1*a*. In this embodiment, the shaft wall thickness Ws is less than the socket wall thickness WMvar and WMcon. Due to the smaller shaft wall thickness Ws, the shaft 2 is deformed, and not the region of the socket 3, that is formed by the greater socket wall thicknesses WMvar and WMcon. In other words, the driven pile 1 is more easily deformable at least in the region along the insertion depth T by virtue of the smaller shaft wall thickness Ws and/or also a softer material structure, than the remaining region of the driven pile 1. The material from which the driven pile 1 is made is at least partially and preferably completely ductile cast steel or ductile cast iron. The abutment 9 is a contact surface which is in the form of a kind of shoulder substantially perpendicular to the longitudinal axis L of the driven pile 1. By virtue of the configuration in the form of a shoulder, the first pile end 1*a* can no longer penetrate more deeply into the driven pile 1 upon coming into contact with the abutment 9. By virtue of the upsetting of the shaft 2 under the effect of force, the shaft 2 must adapt to the contour of the undercut portion 8 in the region thereof. That takes place along the insertion depth T. As a result, that involves a very gentle uniform deformation of a round cross section to a cross section with a plurality of undercut portions 8 or even only one undercut portion 8. The gentle uniform deformation ensures that no cracks are formed in the shaft 2. In accordance with that principle, driven piles 1 can be anchored in a suitable bedrock in a condition of being secured together without using individual components to resist tensile forces or, if necessary, also individually.

Figure 2A:
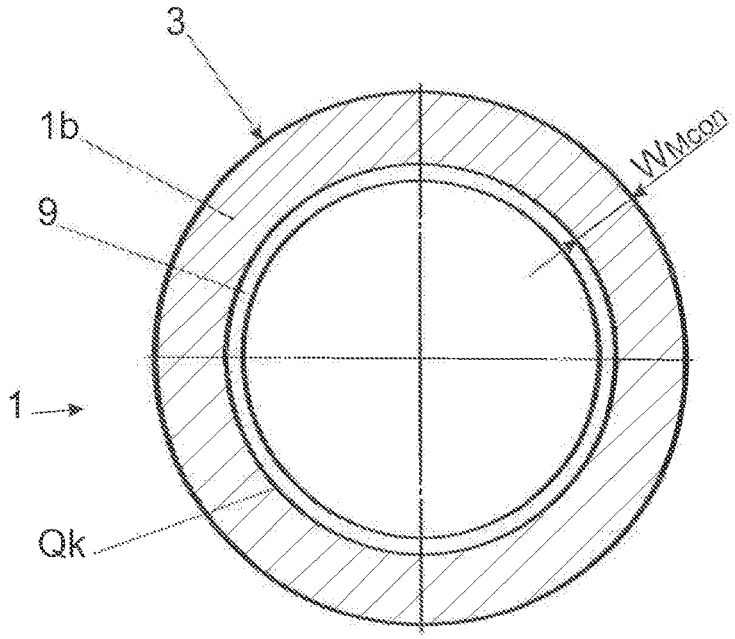
FIGS. 2*a* and 2*b* show cross sections of the driven pile.

FIG. 2*a* shows the second pile end 1*b* of the socket 3. The socket wall thickness is constant in the region of the second pile end 1*b*. The circular cross section Qk thus forms a constant socket wall thickness WMcon. Subsequently, the first pile end 1*a* of a further pile 1 is introduced internally into the constant socket cross section WMcon until it reaches the abutment 9 under the action of the force involved and is upset there. The first pile end 1*a* is not shown in FIG. 2*a*. FIG. 2*a* shows the section 2*a*-2*a* which was shown in FIG. 1 in the side view of the arrangement comprising two driven piles 1.

Figure 2B:
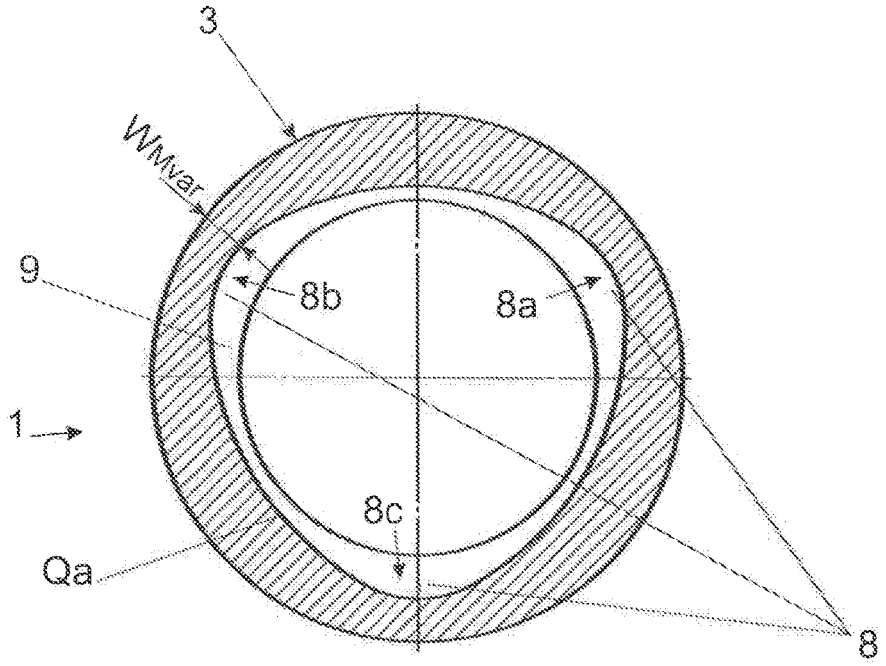

FIG. 2*b* shows the section 2*b*-2*b* which was shown in FIG. 1 in the side view of the arrangement comprising two driven piles 1. The variable socket wall thickness WMvar occurs with increasing insertion depth T (shown in FIG. 1) from the constant socket wall thickness WMcon shown in FIG. 2*a*. The change in the socket wall thickness from WMcon to WMvar affords the undercut configuration 8. In this embodiment, the undercut configuration 8 is produced by a trilobular configuration. In other words, the cross section Qa which differs from a substantially circular cross section Qk is provided by the shape of a trilobular configuration, three undercut regions 8*a*, 8*b* and 8*c* being produced by the trilobular configuration. A cross-sectional shape other than a trilobular configuration is also possible in the production of at least one undercut portion 8. The end of the undercut portion 8 in the interior of the socket 3 and/or the driven pile 1 is afforded by the abutment 9. The variable socket wall thickness WMvar can be both greater in thickness than the constant socket wall thickness WMcon and also smaller than the same. This provides that, when the first pile end 1*a* is being driven in, the diameter of the shaft 2 is portion-wise stretched and also compressed. As a result, the periphery of the shaft 2 is completely retained upon upsetting of the shaft 2 in the region of the undercut portion 8, even if the diameter of the shaft 2 is expanded portion-wise and reduced elsewhere. By virtue of that deformation of the circular cross section, for example, to a trilobular configuration or a polygonal configuration, the periphery is not changed upon portion-wise alteration of the shaft 2 in the region of the first pile end 1*a*. This very careful variation in cross section at the shaft 2 prevents cracks being formed. Cracking would lead to a reduction in the tensile strength of joined driven piles.

Figure 3A:
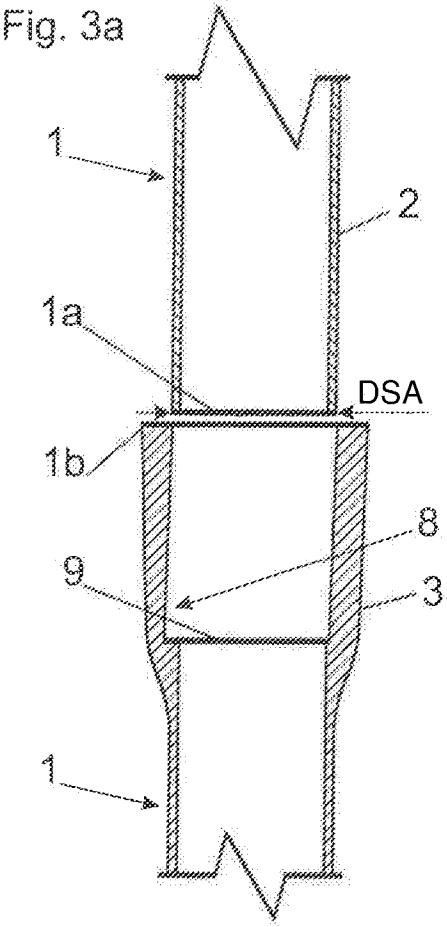
FIGS. 3*a* through 3*c* show individual steps in joining the driven piles.

FIG. 3*a* shows portions of a driven pile 1 which is placed with a first pile end 1*a* thereof over the second pile end 1*b* of a further driven pile 1 with a socket 3. It is possible to see the undercut portion 8 and the abutment 9. The shaft diameter DSA of the shaft 2 is almost the same as the opening cross section of the socket 3 at the second pile end 1*b*.

Figure 3B:
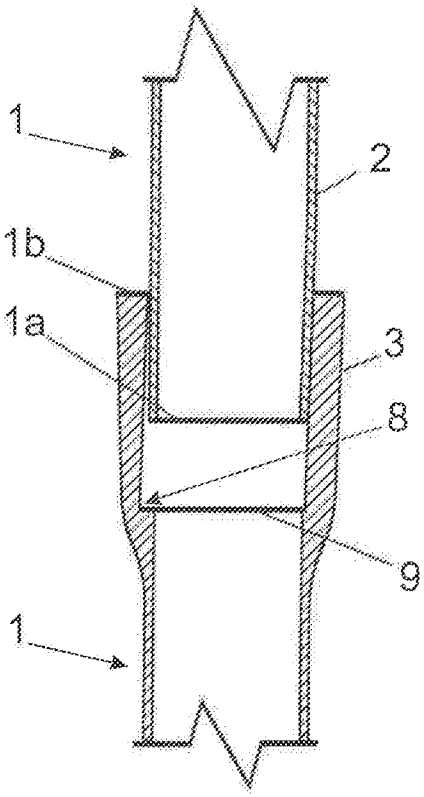

FIG. 3*b* shows how the shaft 2 of the pile 1 is introduced into the socket 3 of a further driven pile 1. In this case, the shaft 2 begins to adapt to the inside wall of the socket 3. A slight change in cross section or a portion-wise change in the shaft diameter DSA at the shaft 2 begins.

Figure 3C:
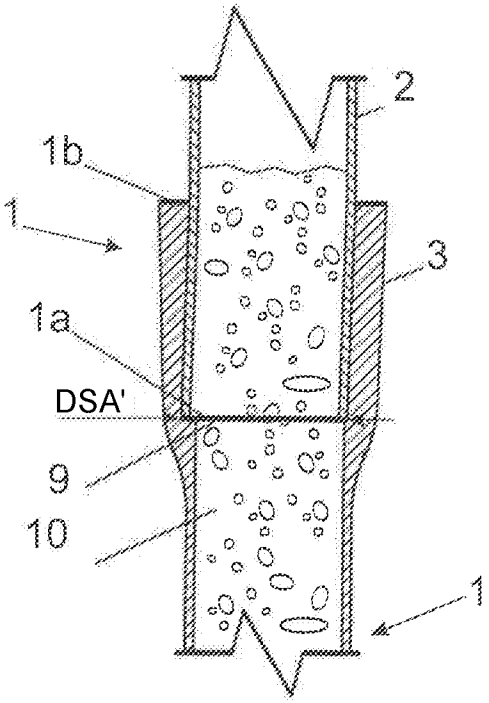

FIG. 3*c* shows how the shaft 2 of the driven pile 1 was placed in the socket 3 of a further driven pile 1. The shaft diameter DSA' has adapted portion-wise to the inside dimensions of the socket 3. By virtue of upsetting of the shaft 2 by the co-operation of the abutment 9 and the undercut portion 8, the shaft diameter DSA is increased or reduced in size relative to the adapted shaft diameter DSA'. After connection of the at least two driven piles 1 by upsetting in the undercut portion 8, a filling material 10, preferably concrete or concrete emulsion, is introduced in order to prevent subsequent return deformation of the shaft 2 under a tensile loading after the filling material 10 has hardened.

Referring to FIGS. 3*a*, 3*b* and 3*c*, it can be seen that the method of joining at least two driven piles 1 comprises at least the following steps:

driving a driven pile 1 into a bedrock with a driving apparatus, wherein the driven pile 1 is driven with the first pile end 1*a* leading into the bedrock, inserting a further driven pile 1 with the first pile end 1*a* into the socket 3 of the preceding driven pile 1, that is provided with an undercut portion 8, and driving the further driven pile in by means of a driving apparatus, driving in to the required depth of the arrangement of driven piles 1, wherein, in the driving-in operation, the first pile end 1*a* adapts to the internal contour of the socket 3 by crack-free deformation, wherein tensile securing is afforded by virtue of the at least one undercut portion 8, which is preferably afforded by the change in cross section from a substantially circular cross section to the cross section in the form of a trilobular configuration, possibly inserting further driven piles 1 and driving the further driven piles in as described in the preceding steps, and filling the arrangement of driven piles 1 with a filling material 10, preferably concrete or concrete emulsion, for impeding return deformation of the first pile end 1*a* which is deformed by virtue of the undercut portion 8.

The invention claimed is:

1. A driven pile comprising a substantially cylindrical shaft, wherein the substantially cylindrical shaft provides a first pile end and a second pile end, wherein a socket is arranged on the driven pile in a region of the second pile end, wherein the socket or the driven pile has an abutment in the region of the second pile end so that a further driven pile can be inserted with a first pile end as far as a maximum insertion depth defined by the abutment, wherein, in the region of the second pile end, at least one of an interior of the socket and an interior of the driven pile provides at least one undercut portion, the at least one undercut portion extending inwardly at least substantially to the abutment, wherein, in a cross section perpendicular to a longitudinal axis of the driven pile at the abutment, an outer shape of the driven pile is circular and an inner shape of the driven pile is trilobular such that a wall thickness of the driven pile is variable at the cross section perpendicular to the longitudinal axis of the driven pile at the abutment, and wherein the socket changes from a circular opening to a trilobular opening along a depth of the socket so as to create the at least one undercut portion extending inwardly at least substantially to the abutment.

2. The driven pile as set forth in claim 1, wherein the cross section perpendicular to the longitudinal axis of the driven pile at the abutment is a first cross section, and the at least one undercut portion is provided by a change in a cross section of the socket from a second substantially circular cross section at the second pile end to the first cross section, that deviates from the second substantially circular cross section.

3. The driven pile as set forth in claim 2, wherein the at least one undercut portion includes three undercut portions.

4. The driven pile as set forth in claim 1, wherein the at least one undercut portion extends at a maximum angle in the interior of the socket of between 1.5° and 3° measured relative to the longitudinal axis of the driven pile.

5. The driven pile as set forth in claim 1, wherein the driven pile is substantially tubular, and wherein the substantially cylindrical shaft has a substantially constant shaft wall thickness in a region at least along a maximum insertion depth thereof starting from the first pile end.

6. The driven pile as set forth in claim 1, wherein the socket at the second pile end has a substantially constant socket wall thickness, and starting from the second pile end along the maximum insertion depth is of a variable socket wall thickness by virtue of the at least one undercut portion.

7. The driven pile as set forth in claim 1, wherein the abutment is provided by a contact surface arranged substantially perpendicularly to the longitudinal axis of the driven pile.

8. The driven pile as set forth in claim 1, wherein the driven pile at least partially comprises ductile cast steel or cast iron.

9. The driven pile as set forth in claim 1, wherein the driven pile is more easily deformable at least in a region along the maximum insertion depth by virtue of having a smaller shaft wall thickness or a softer material structure, than a remaining region of the driven pile.

10. A method of joining at least two driven piles as set forth in claim 1, wherein the method includes:

(i) driving a first of the at least two driven piles into a bedrock with a driving apparatus, wherein the first of the at least two driven piles is driven with the first pile end of the first of the two driven piles leading into the bedrock, (ii) inserting a second of the at least two driven piles into the socket of the first of the at least two driven piles, and driving the second of the at least two driven piles in with the driving apparatus, (iii) driving in to a required depth of the at least two driven piles, wherein, the first pile end of the second of the at least two driven piles adapts to an internal contour of the socket of the first of the at least two driven piles, and (iv) filling the at least two driven piles with a filling material for impeding return deformation of the first pile end of the second of the at least two driven piles which is deformed by virtue of the at least one undercut portion of the first of the at least two driven piles.

11. The method as set forth in claim 10, wherein the at least two driven piles include further driven piles inserted and driven in according to steps (i)-(iii).

12. The driven pile as set forth in claim 8, wherein the driven pile completely comprises ductile cast steel or cast iron.

13. The driven pile as set forth in claim 1, wherein the driven pile is more easily deformable at least in a region along the maximum insertion depth by virtue of having a smaller shaft wall thickness and a softer material structure, than a remaining region of the driven pile.

* * * * *